United States Patent [19]

MacPhail

[11] Patent Number: 4,700,109

[45] Date of Patent: Oct. 13, 1987

[54] CROSSED-FIELD AMPLIFIER

[75] Inventor: Guilford R. MacPhail, Williamsport, Pa.

[73] Assignee: Litton Systems, Inc., Beverly Hills, Calif.

[21] Appl. No.: 656,495

[22] Filed: Oct. 1, 1984

[51] Int. Cl.[4] ..... H01J 25/34

[52] U.S. Cl. ..... 315/39.3; 313/22; 313/32; 313/30; 313/39

[58] Field of Search ..... 313/30, 31, 32, 22, 313/39, 346; 315/39.3

[56] References Cited

U.S. PATENT DOCUMENTS

| | | | |
|---|---|---|---|
| 3,320,471 | 5/1967 | Mims | 315/39.3 |
| 3,536,952 | 10/1970 | Findley | 313/31 |
| 3,612,932 | 10/1971 | Wilczek | 313/39 |
| 3,666,983 | 5/1972 | Krah et al. | 315/39.3 |
| 4,028,583 | 6/1981 | Bigham | 315/39.63 |
| 4,256,990 | 3/1981 | Busacca et al. | 313/22 |
| 4,274,032 | 6/1981 | Dodonov et al. | 315/39.69 |

*Primary Examiner*—David K. Moore
*Assistant Examiner*—Michael Razavi
*Attorney, Agent, or Firm*—Gerald L. Cline

[57] ABSTRACT

An improvement to an existing crossed-field amplifier is shown which includes the replacement of an existing thermionic emitter with a larger platinum emitter. The platinum emitter is cooled from a surface opposite to the surface upon which a high voltage is applied to permit the form of the existing crossed-field amplifier to be maintained.

12 Claims, 5 Drawing Figures

CROSSED-FIELD AMPLIFIER

The present invention relates to a crossed-field amplifier and, more particularly, to an improved cathode and cooling system therefore.

BACKGROUND OF THE INVENTION

The present invention was developed by necessity created by the inability of an existing radar system to function properly within its environment. The cross-field amplifier used within the radar system has a tendency to a high rate of failures. One reason for these failures is that the thermionic emitter cathode of the amplifier, which operates on the principle of direct heating to boil off electrons, tends to arc when started cold. Start-ups thus creates an instability wherein the cathode has a tendency to arc which cause damage to the crossed-field amplifier.

A crossed-field amplifier of the thermionic emitter type has been utilized in many existing radar systems for several years. Thus, any design change of the amplifier must be capable of a retrofit into the existing radar facility.

It has been known for approximately ten years that a so-called long circuit crossed-field amplifier utilizing a pure platinum emitter can meet the stability requirements of the existing equipment. However, a platinum emitter is a secondary emitter that requires the acceleration of electrons toward a larger emitter to drive off additional electrons which spin toward the anode. This larger sized emitter makes it difficult to retrofit into an existing radar system. Further, because of the need to liquid cool the platinum emitter, the hardware necessary to accomplish the retrofit does not fit into the existing equipment space.

SUMMARY OF THE INVENTION

Accordingly, it is an object of the present invention to provide a unique arrangement that will permit the replacement of a thermionic emitter with a larger platinum emitter in a crossed-field amplifier without changing the form or function of that amplifier.

Another object of the present invention is to provide a unique cooling system for liquid cooling the platinum emitter cathode.

In accomplishing these and other objects, there is provided an oil filled reservoir that completely surrounds a standpipe connected directly to the cathode. As the cathode is at a high voltage potential, typically 55 KV, the potential must be insulated from the coolant and other hardware within the crossed-field amplifier. Such insulation is accomplished by the used of ceramic disc mounted within the reservoir about the cathode coolant standpipe. The reservoir is oil filled to surround the terminus of the standpipe and prevent the discharge of a high potential from the standpipe to the reservoir. An electrically insulted cooling system permits the flow of coolant from outside the oil reservoir to the terminus of the standpipe.

The standpipe mounts upon the upper surface of the platinum emitter and is provided with an inner and outer tube for supplying a coolant to the center of the cathode which carries off unwanted heat. While water cooled platinum emitter cathodes are known, the prior art cools such cathodes from the surface thereof connected to the high voltage potential. In the present invention, the cooling connection is made to the opposite surface. This unique connection is necessary to retain the form, fit and function of the existing crossed-field amplifier.

DESCRIPTION OF THE DRAWINGS

Further objects and advantages of the present invention will become apparent after consideration of the following specification when considered with the accompanying drawings, wherein.

DESCRIPTION OF THE PREFERRED EMBODIMENT

Figure 1:
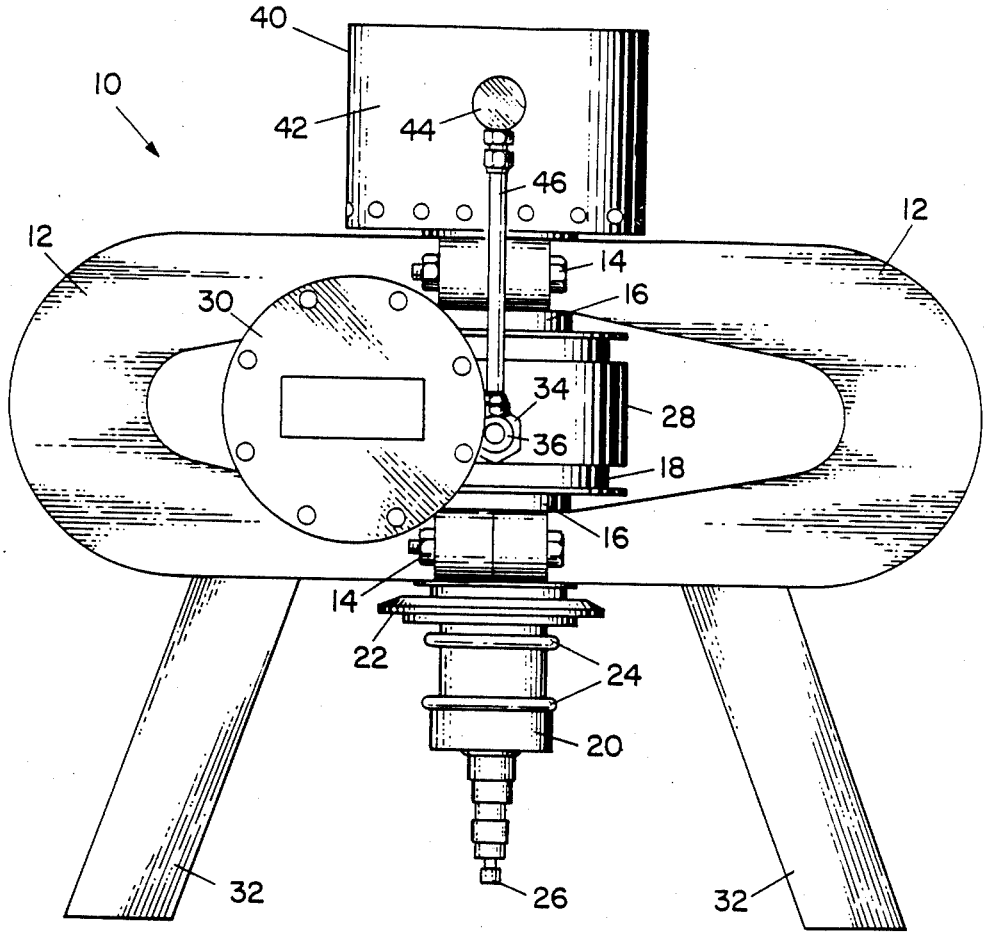
FIG. 1 is a side view of a crossed-field amplifier showing the configuration of an existing device modified by the present invention.

Referring now to the drawings, FIG. 1 shows a crossed-field amplifier 10 formed between a pair of U-shaped permanent magnets 12 bolted together at the end of each U by bolts 14. Extending between the legs of each U-shaped magnet are pole pieces 16 which pass into the upper and lower surfaces of a cathode/anode housing 18. The lower surface of the cathode/anode housing mounts a high voltage terminal housing 20 having a flange 22 mounted about its upper surface and a pair of corona shields 24 located on the outer surface of housing 20 just below flange 22. A high voltage terminal 26 extends from the lower surface of the housing 20 which receives a potential for operating the amplifier 10.

Figure 2:
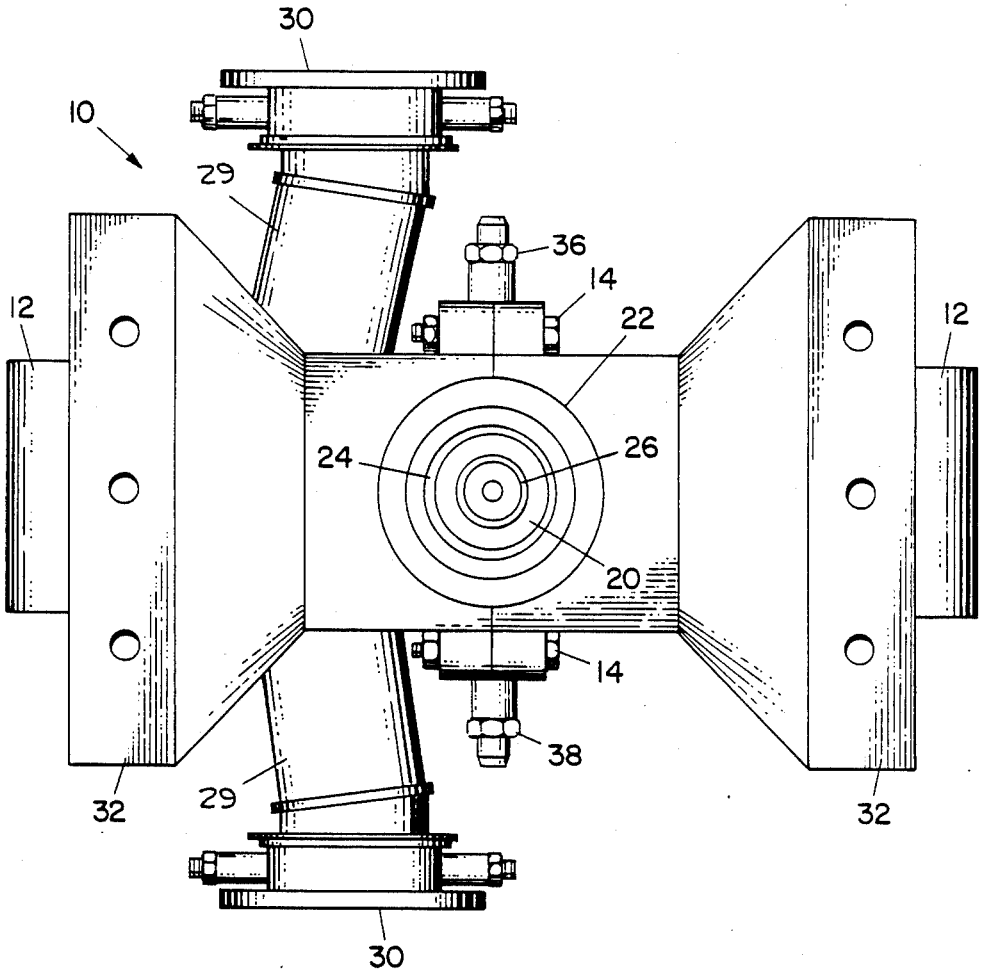
FIG. 2 is a bottom view of the crossed-field amplifier shown in FIG. 1.
Figure 3:
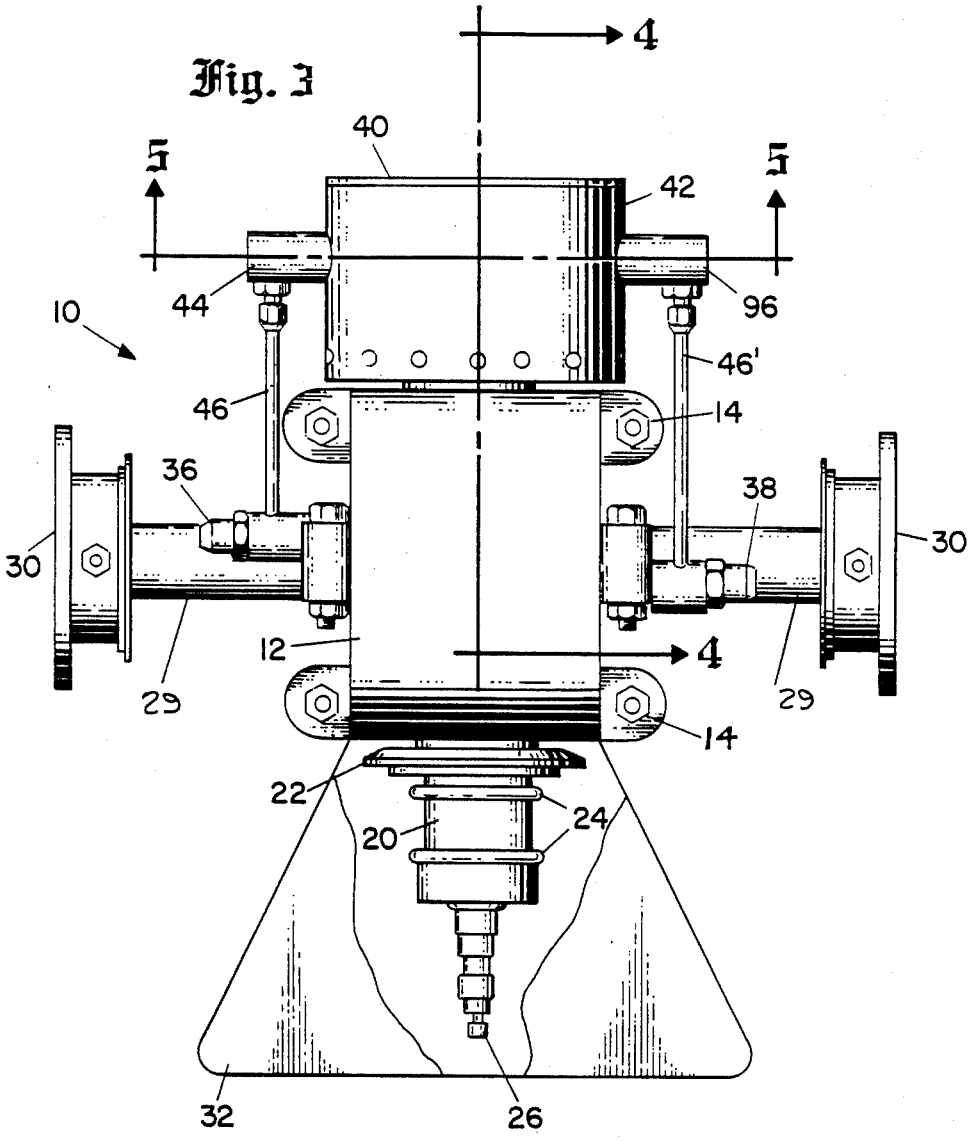
FIG. 3 is an end view of the crossed-field amplifier shown in FIG. 1.
Figure 4:
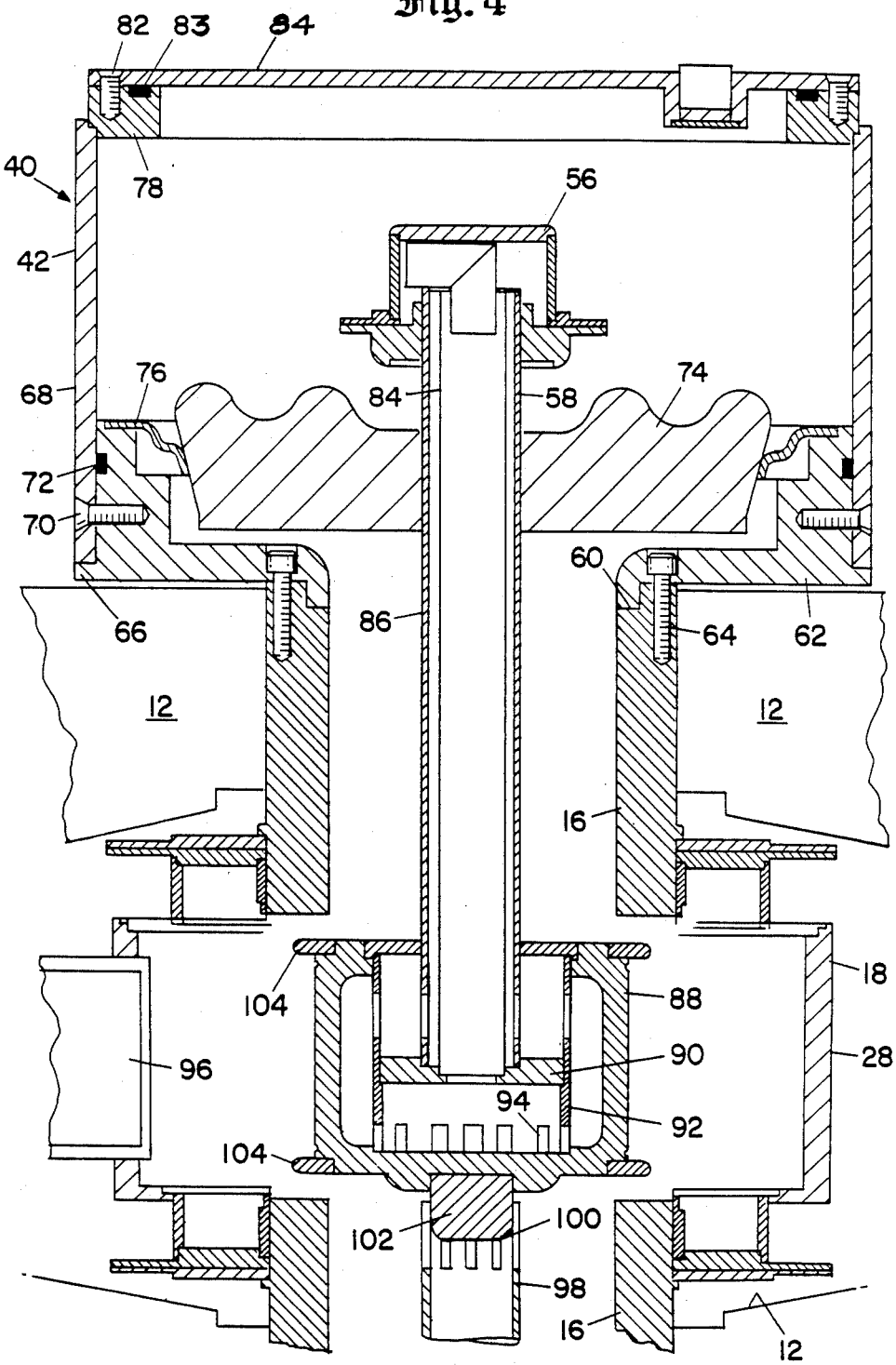
FIG. 4 is a cross-sectional view taken along the lines 4—4 of FIG. 3.

The cathode/anode housing 18 includes the anode 28 which may be seen as the outer surface of housing 18 in FIG. 1 but is best seen in FIG. 4. Extending from the cathode/anode housing 18 is a wave guide assembly 29 (FIGS. 2 and 3) of which only the waveguide flange 30 is shown in FIG. 1. A pair of mounting feet 32 extend from the lower surfaces of each of the U-shaped permanent magnets 12. The cathode/anode housing 18 is normally cooled by a coolant system 34 including a coolant input port 36 and an output port 38 (FIG. 2).

As mentioned above, the crossed-field amplifier 10 described thus far is an existing piece of equipment which has been used for some time to generate the microware energy used in various radar systems. This prior art crossed-field amplifier included a thermionic emitter cathode which is heated to drive off electrons. The emitter is prone to failure due to an unstable condition created when the amplifier is turned on. The reason being that a cold cathode may arc and damage the amplifier. While the amplifier is running, it is cooled by flowing a coolant through the cooling system 34 at input port 36. The cathode terminal housing 20 is also cooled by placing it in an oil bath, not shown, which extends about the housing 20 up to the flange 22.

The present invention replaces the old thermionic emitter with a liquid-cooled pure platinum emitter, Fig. 4. While platinum emitters are known, they are not easily substituted for thermionic emitters due to a large size and the requirement for cathode cooling. For example, the platinum emitter of the present invention has an outside diameter of approximately 2.35 inches. This secondary platinum emitter replaces the old primary emitter which had an outside diameter of but 0.8 inches. The present invention, permits a larger cathode and provides for cathode cooling while retaining the configuration of the existing amplifier.

As seen in FIGS. 1 and 4, the present invention cools the cathode from a surface opposite to the high voltage connection surface. This arrangement permits the continued use of the oil bath cooler, not shown, in which the high voltage cathode terminal 26 and its housing 20 are immersed. Cathode cooling is accomplished through the utilization of a parallel cathode cooling system 40 which includes a transformer oil filled reservoir 42 mounted on the top of the crossed-field amplifier 10. Coolant from the same supply that supplies the anode cooling system 34 is directed into the reservoir by an input port 44 which is connected to input port 36 by a vertifical tubing 46. From input port 44 the coolant is carried through a plumbing connector 48, see FIG. 4, to a thermodynamically and electrically insulated tube 50 which, in turn, connects through a second connector 54 to a manifold 56 mounted upon the top of the standpipe 58. The standpipe is attached to the cathode as described below. Insulated tube 50 may be constructed from various materials such as a polyallomer sold under the tradename Impolene. The transformer oil is sold under the tradename Univolt.

As seen in FIG. 4, the upper pole piece 16 is provided with a shoulder 60 that receives a toroidally shaped reservoir base plate 62 which is attached to the pole piece 16 as by screws 64. A flange 66 extends from the outer, lower surface of plate 62 to provide a stop for a tubularly shaped reservoir wall 68 attached to the base plate 62 by screws 70. Wall member 68 is sealed against the base plate 62 by an O-ring 72.

The inner diameter of toroidally shaped base plate 62 is closed by a low profile insulating disc 74 whose inner surfaces have been raised and rounded to proved a corona shield. The disc 74 is connected to plate 62 by a toroidally shaped flexure member 76 that may be welded to the base member 62 and bonded to insulator 74. The upper portion of oil reservoir 42 mounts a ring shaped member 78 which is attached, as by welding. Mounted upon the member 78 is a cover 80 that is secured thereto by screws 82 and sealed by an O-ring 83.

The standpipe 58 includes concentric inner and outer pipes 84 and 86, respectively. Coolant flowing through the connector 54 and into the manifold 56 flows down the inner pipe 84 to the cup-shaped cathode 88 where the inner pipe is mounted within a recess within a disc 90. The disc mounts within an inner sleeve 92 whose lower surfaces are slotted at 94 to permit the coolant to pass from the inner surface of sleeve 92 to its outer surface where the coolant flows in an upwardly direction along the inner surfaces of the cup-shaped cathode 88. The coolant is then returned through an aperture in the upper surfaces of sleeve 92 and through apertures in the lower end of the outer pipe 86 wherein the coolant flows in an upwardly direction back to the manifold 56.

Figure 5:
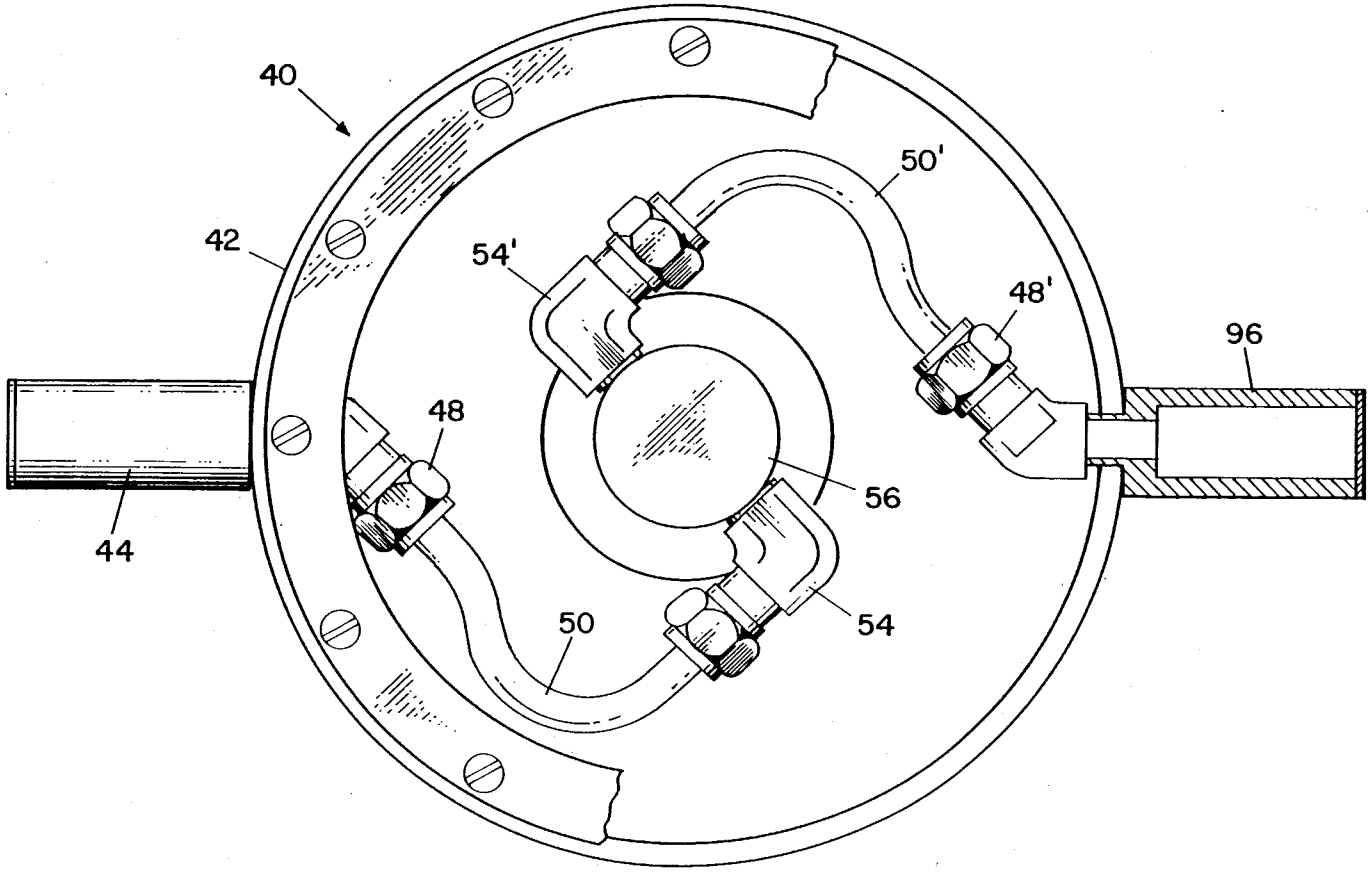
FIG. 5 is a cross-sectional view taken along the lines 5—5 of FIG. 3.

It will be seen in FIG. 5, that the coolant passes through a second connector 54'; and a second insulating tube 50' to a second outer connector 48' and then to an output port 96. From output port 96, the coolant flows down a second vertical pipe 46' to the output port 38, FIG. 3.

Referring once again to FIG. 4, it will be understood that the secondary emissions from the surface of cathode 88, formed by the thin, plated layer of platinum upon a copper surface, cause the resultant electrons to boil from that surface across the field established by pole pieces 16 toward the anode 28. A microwave output port 96 captures the electrons and passes them on through the microwave guide assembly 29 and flange 30. In the preferred embodiment, cathode 88 may be maintained at 55,000 volts by a potential applied to the high voltage terminal 26 connected to the cathode 88 by a high voltage connection tube 98. The upper end of tube 98 is slotted with slots 100 to provide a flexible connection to a voltage post 102 which connects to the lower surface of the cup-shaped cathode 88. The outer surface of the cathode 88 is provided with upper and lower shielding rings 104 to prevent the leakage of electrons as they boil from the surface of cathode 88 toward anode 28.

In the preferred embodiment, the coolant applied to the anode 28 and cathode 88, is deionized water. This nonconductive cooling water prevents the passage of the high voltages upon cathode 88, standpipe 58, and manifold 56 through the coolant in tubes 50 to the outside of the crossed-field amplifier 10. Tubes 50 are also insulators to prevent the voltage from passing therethrough. The ceramic insulating disc 74 further isolates the high voltage on standpipe 58 from the outer surfaces of the reservoir 42 and amplifier 10. Finally, the reservoir 42 is filled with transformer oil to prevent a discharge from the manifold 56 and its standpipe 58 toward the reservoir 42.

Because of the large outer diameter of the cathode 88 and the larger outer diameter of the anode 28, it is necessary to locate the microwave output port 96 at a distance further to the outside extreme of the crossed-field amplifier 10 than in the prior system. To correct for this displacement, the microwave guide assemblies 29, FIGS. 2 and 3, are offset to return the microwave flanges 30 to their original position.

I claim:

1. In a crossed-field amplifier having a pair of magnetic pole pieces which create a magnetic field across an electric field established by an anode and a cathode, said anode retained at a reduced temperature by a coolant, the improvement comprising:

a source of high voltage;

said cathode having an electron emitting surface and at least two non-emitting surfaces, one non-emitting surface connected to said source of high voltage to establish said high voltage on both non-emitting surfaces;

a coolant standpipe connected to a second non-emitting surface of said cathode opposite from said first non-emitting surface, said standpipe thus maintained at the same high voltage as said cathode;

a reservoir mounted upon said crossed-field amplifier;

said standpipe extending into said reservoir;

first insulator means surrounding said standpipe for mounting said standpipe within said reservoir and electrically isolating said high voltage of said standpipe from said reservoir;

piping means for directing said coolant to said reservoir;

second insulating means connected between said piping means and said standpipe for electrically isolating said high voltage of said standpipe from said piping means and for passing said coolant through said piping means and said reservoir to said standpipe to cool said cathode.

2. In a crossed-field amplifier as claimed in claim 1, the improvement further comprising;

said cathode is a platinum emitter cathode.

3. In a crossed-field amplifier as claimed in claim 1, the improvement further comprising;

said reservoir is filled with a nonconductive cooling oil to electrically and thermodynamically insulate said standpipe from said reservoir.

4. In a crossed-field amplifier as claimed in claim 1, the improvement further comprising;

said first insulating means is a toroidally shaped disc of ceramic material that forms and seals the lower surface of said reservoir.

5. In a crossed-field amplifier as claimed in claim 1, the improvement further comprising;

said piping means includes an inlet the outlet pipe connected to carry said coolant to said standpipe through said second insulating means;

said standpipe has an inner and outer pipe to carry said coolant from said inlet pipe to said cathode and back to said outlet pipe; and said second insulating means is insulated tubing for connecting said inlet and outlet pipes to said standpipe.

6. In a crossed-field amplifier as claimed in claim 5, the improvement further comprising;

said insulating tubing is polymer.

7. In a crossed-field amplifier as claimed in claim 1, the improvement further comprising;

said coolant is deionized water.

8. A crossed-field amplifier having an anode and cathode creating an electric field across a magnetic field, comprising:

said cathode having an electron emitting surface and first and second opposing surfaces on each side of said emitting surface;

a source of high voltage connected to said first surface of said cathode;

a cooling standpipe connected to said second surface of said cathode extending beyond said amplifier and maintained at the same high voltage as said cathode;

a reservoir surrounding said standpipe as it extends from said amplifier;

insulating means for mounting said standpipe within said reservoir;

a source of coolant;

means for carrying said coolant to said reservoir;

second insulating means connecting said means for carrying said coolant to said standpipe to carry coolant thereto; and means within said standpipe for carrying said coolant to and from said cathode.

9. A crossed-field amplifier as claimed in claim 8, wherein:

said reservoir is filled with a nonconductive fluid to electrically and thermodynamically isolate said standpipe therefrom.

10. A crossed-field amplifier, as claimed in claim 8, wherein:

said first mentioned insulating means is a disc of ceramic material through which said standpipe extends and which seals the lower surface of said reservoir.

11. A crossed-field amplifier, as claimed in claim 8, wherein:

said means for carrying said coolant to said reservoir includes an inlet and outlet pipe;

said second insulating means are insulated tubes; and said means within said standpipe include inner and outer piping connected to said inlet and outlet pipes by said insulated tubes.

12. In a crossed-field amplifier having a first magnetic field and a second electric field established by an anode and a cathode, said anode being cooled by a coolant, the improvement comprising;

a source of high voltage;

said cathode having a first surface to which said source of high voltage is connected and a second opposite surface, said cathode and first and second surfaces thus maintained at said high voltage;

a cooling standpipe connected to said second surface of said cathode, said standpipe thus maintained at said high voltage;

a reservoir filled with an insulating fluid;

said reservoir having an insulating disc os ceramic material forming its bottom surface through which said standpipe extends from mounting said standpipe within said reservoir;

piping means for connecting and carrying said coolant to said reservoir; and insulating tubing means within said reservoir for connecting said piping means to said standpipe to carry coolant to said standpipe and said cathode; wherein said standpipe is insulated from said reservoir by said insulating fluid, said insulating disc, and said insulating tubing means.

* * * * *